US006363627B1

(12) United States Patent
Lai

(10) Patent No.: US 6,363,627 B1
(45) Date of Patent: Apr. 2, 2002

(54) CLOTHES DRYER

(76) Inventor: A-Chu Lai, No. 4-6, Hsiu Shan Road, Taya Shien, Taichung Hsien (TW)

( * ) Notice: Subject to any disclaimer, the term of this patent is extended or adjusted under 35 U.S.C. 154(b) by 0 days.

(21) Appl. No.: 09/612,004

(22) Filed: Jul. 7, 2000

(51) Int. Cl.[7] ..... F26B 9/00; F26B 13/00; F26B 13/06

(52) U.S. Cl. ..... 34/621; 34/106

(58) Field of Search ..... 219/553; 392/365; 34/621, 622, 106

(56) References Cited

U.S. PATENT DOCUMENTS

| | | | | | |
|---|---|---|---|---|---|
| 3,739,492 | A | * | 6/1973 | Brooks | 34/622 |
| 4,245,146 | A | * | 1/1981 | Shioi et al. | 219/553 |
| 4,593,179 | A | * | 6/1986 | Schultz et al. | 392/365 |
| 5,555,648 | A | * | 9/1996 | Griffin | 34/621 |
| 6,047,482 | A | * | 4/2000 | Roper | 34/106 |

FOREIGN PATENT DOCUMENTS

| | | | | |
|---|---|---|---|---|
| JP | 410192596 | * | 7/1998 | D06F/59/00 |
| JP | 411019398 | * | 1/1999 | D06F/58/00 |
| JP | 2000157482 | * | 6/2000 | A47L/19/00 |
| JP | 2000230780 | * | 8/2000 | D06F/58/10 |

* cited by examiner

*Primary Examiner*—Teresa Walberg
*Assistant Examiner*—Leonid M Fastovsky
(74) *Attorney, Agent, or Firm*—Pro-Techtor International Services

(57) ABSTRACT

A clothes dryer includes a housing and a hollow tube connected to a first end of the housing. The housing has plural lengthwise narrow air inlets formed in a bottom, a wind leaves wheel rotated by a motor and a heater in its interior, and a wind outlet formed in the first end connected to a hollow tube extensible and shrinkable. The hollow tube has a lengthwise L-shaped rail for hanging plural J-shaped hooks for hooking washed wet clothes and two lengthwise lines of wind exhaust holes at two sides of the rail. Thus, outer cool air flows through the air inlet holes in the housing and heated up by the heater and then blown by the wind leaves wheel into the hollow tubes and then flows out of the wind exhaust holes to dry clothes hung on the hooks under the hollow tube.

5 Claims, 4 Drawing Sheets

A–A

CLOTHES DRYER

BACKGROUND OF THE INVENTION

This invention relates to a clothes dryer, particularly to one easy to use, taking a small space for storing away owing to a small size after collapsed.

Drying washed wet clothes equipment is usually installed in a balcony outside a room of a house, an apartment, or a condominium, owning to the space limited. But if the weather is bad and rainy, washed wet clothes may not be able to hang outside a room, and have to be hung inside a room. Then the time needed for wet clothes to dry out may be prolonged to cause various inconveniences. In addition, if wet clothes are hung in a room comparatively for a long time, the moisture in the room may be thick and produce odor, bad to smell. Although clothes dryers have been made, they are always too large to be used in common houses or apartments. Besides, clothes dried in the dryers form a large mass mixing with one another, having many wrinkles.

SUMMARY OF THE INVENTION

This invention has been devised to offer a clothes dryer of a small size, taking a small space, and easy to store away.

The feature of the invention is a housing containing a wind leaves wheel and a PTC heater and a hollow tube connected to a first end of the housing and adjustable in its length so as to be positioned between two opposite walls of a room in case of rainy weather. Then cool air flows through air inlet lengthwise holes into the housing and heated up by the heater to be blown by the wind leaves wheel to flow into the hollow tube and exhausted out of two lengthwise lines of wind exhaust holes to dry washed wet clothes hung on hooks hooked on a lengthwise rail of the hollow tube.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
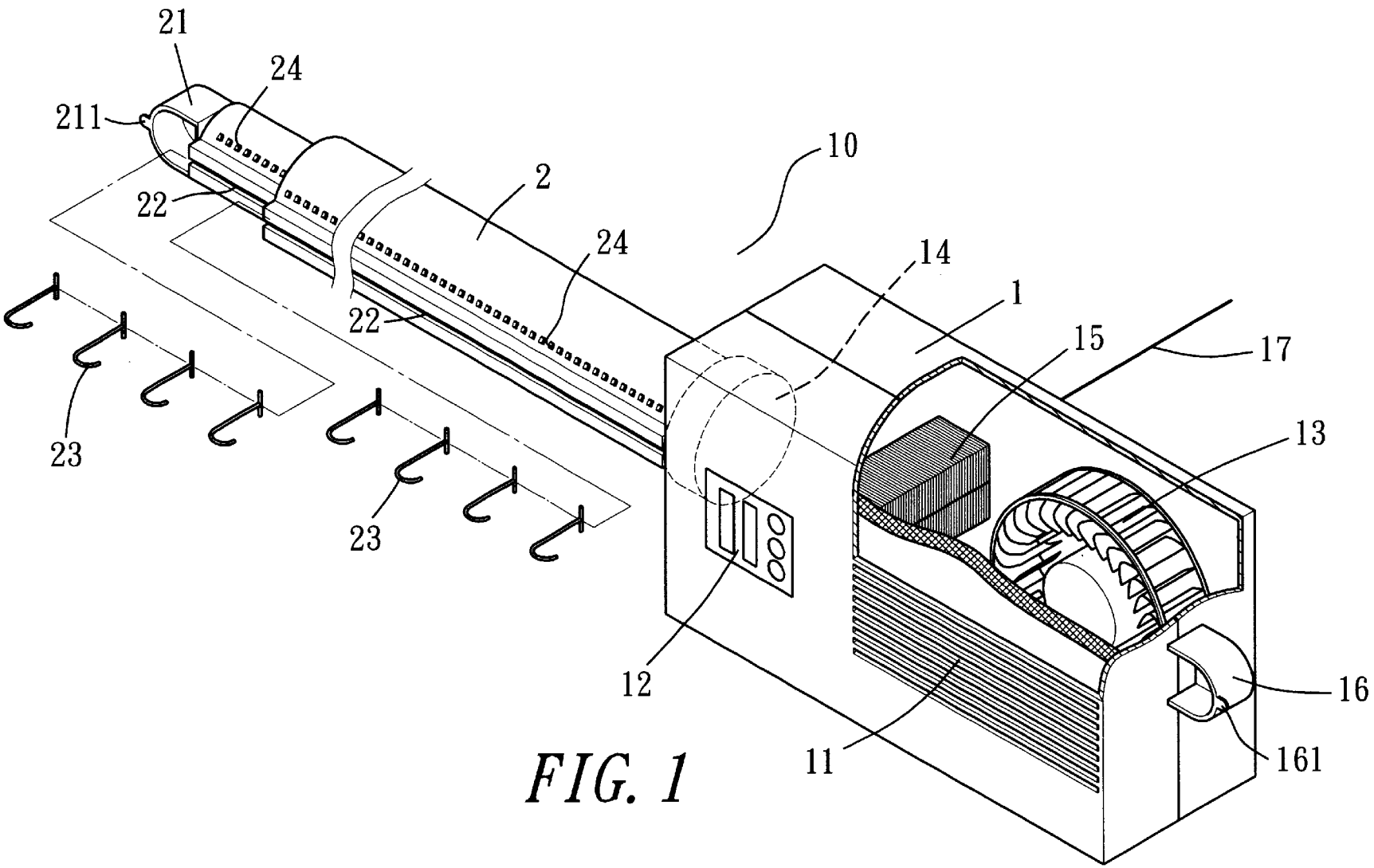
FIG. 1 is a partial cross-sectional and perspective view of a clothes dryer in the present invention.
Figure 2:
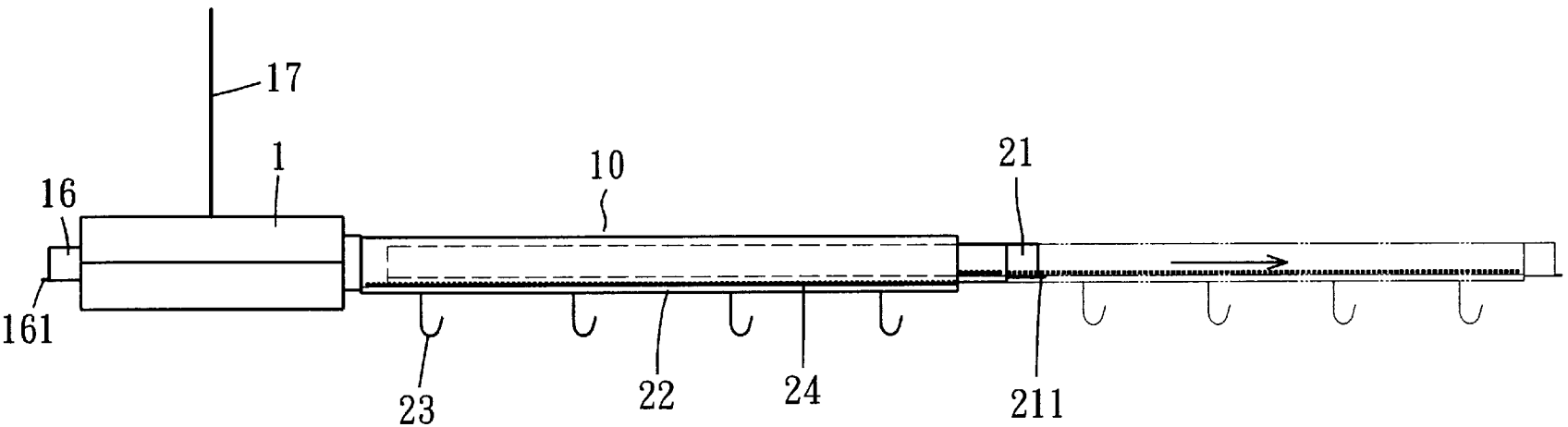
FIG. 2 is a side view of the clothes dryer in a using condition in the present invention.

A preferred embodiment of a clothes dryer in the present invention, as shown in FIGS. 1 and 2, includes a housing 1, a hollow tube 2 connected to a first end of the housing 1 as main components.

The housing 1 has a hang rope 17 fixed on an outer upper surface, plural lengthwise air inlets 11 formed in a bottom wall and communicating with an interior, and a control panel 12 positioned on a side of the air inlets 11 for controlling turning on and off power of the dryer, operating time and temperature of a heater in the housing. Further, the housing 1 has a wind leaves wheel 13 (such as turbine leaves) in its interior above the air inlets 11, a wind outlet 14 formed in a front end, and a PTC (positive temperature coefficient) heater 15 positioned between the wind leaves 13 and the wind outlet 14. A support member 16 of a lateral U-shape is fixed on a second end (the right side in FIG. 1), having a small press projection 161 protruding forward.

Figure 4:
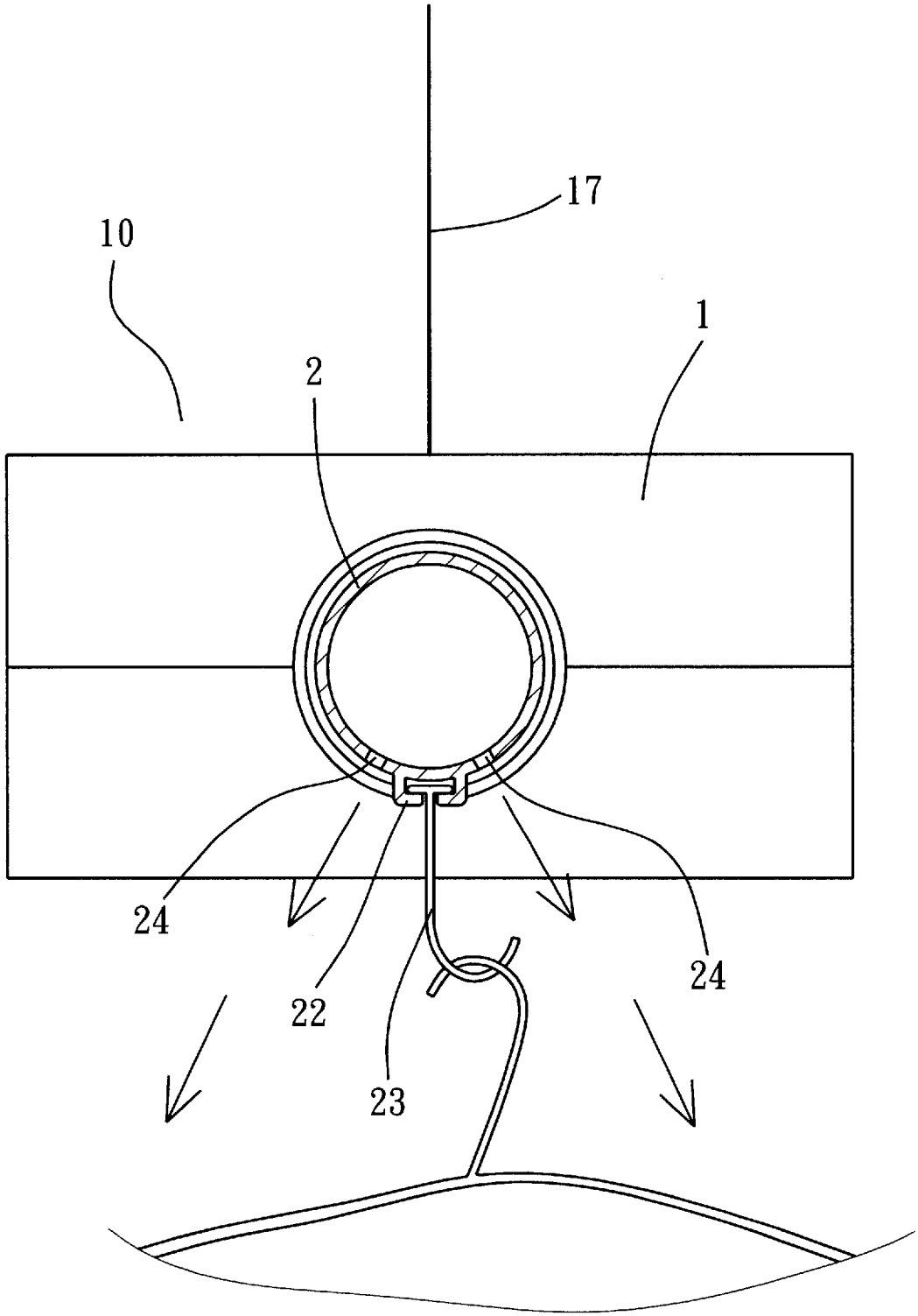

The hollow tube 2 has two parallel L-shaped glide rails 22 formed lengthwise, and plural hang hooks 23 of a J shape fitted in the slide rails 22, and a lengthwise line of wind exhaust holes 24 spaced apart very near respectively formed above and parallel to the rails 22. The two lines of the wind exhaust holes 24 are formed 45 degrees or so to each other in exhausting wind, as shown in FIG. 4.

Figure 3:
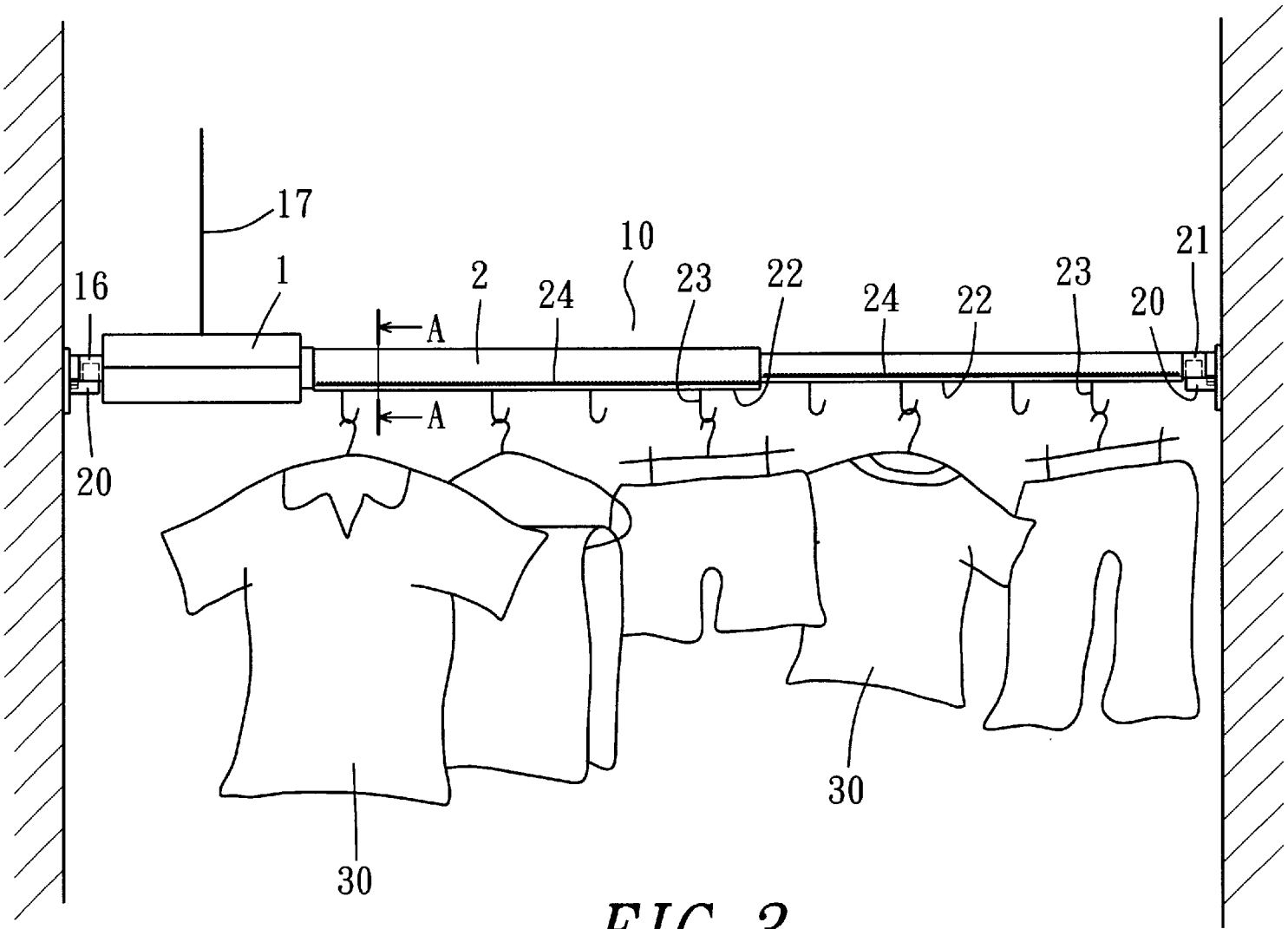
FIG. 3 is a side view of the clothes dryer in another using condition in the present invention: and, FIG. 4 is a cross-sectional view of the line A—A in FIG. 3.

In using, as shown in FIGS. 2 and 3, firstly, two opposite walls between which the clothes dryer is to be installed are respectively provided with a supporter 20 at a proper height. Then the inner portion is telescoped out of the outer portion of the hollow tube 2 adjusted in its length, with the support member 16 of the first end of the housing 1 and the support member 21 at the front end of the inner portion of the tube 2 may be respectively placed on the supporters 20 of the two opposite walls, and then take two position blocks hooked on the bottom and insert them on the supporters 20 engage the press projections 161, 211 of the support members 16, 21. Then the clothes dryer 10 is secured between the two opposite walls, with the hang rope 17 hung on the ceiling of a room to assist supporting the clothes dryer 10. When washed wet clothes cannot be hung in the balcony, the clothes dryer can be installed between two opposite walls of a room, with the hangers 23 fitted in the slide rails 22 for hanging washed wet clothes on, as shown in FIG. 3. Then turn on power of the clothes dryer to let the heater 15 produce heat, and the wind leaves wheel 13 begin to rotate to suck in cold air through the air inlets 11 into the housing 1, and then heated up by the heater 15 to be blown into the hollow tube 2 by the wind leaves wheel 13, exhausted out of the two lines of the wind exhaust holes 24 toward the hung wet clothes 30, as shown in FIG. 4, drying them in due time.

Thus, the clothes dryer is normally stored away, possible to be taken out when necessary, and installed between two opposite walls for hanging and drying by sending out hot wind produced by means of the heater and the wind leaves to blow out of the air exhaust holes of the hollow tube. Further, the length of the clothes dryer can be adjusted by telescoping the inner portion in the outer portion of the hollow tube to correspond to the distance between two opposite walls, very convenient to use and to store away as well. Thus conventional disadvantages of worsening appearance of a room, possible bad odor, inconvenience of a large dryer can be solved.

While the preferred embodiment of the invention has been described above, it will be recognized and understood that various modifications may be made therein and the appended claims are intended to cover all such modifications that may fall within the spirit and scope of the invention.

I claim:

1. A clothes dryer comprising:

a housing with a tube connected to a first end of said housing, said housing having plural lengthwise air inlets in a side thereof, a motor driven fan positioned above said air inlets, an air outlet formed at said first end of said housing and being in communication with said tube, a heater positioned between said fan and said air outlet; wherein said tube comprises a closed distal end and two lines of air exhaust holes formed therein, so that cool air is drawn into said housing through said air inlets in said housing and heated by said heater, heated air then being blown by said fan into said hollow tube and then flowing out of said two lines of air exhaust holes, and wherein said tube comprises an outer portion and an inner portion telescoping in said outer portion so that an overall length of said clothes dryer is changeable so that said clothes dryer is mountable in rooms of varying sizes.

2. The clothes dryer as claimed in claim 1, wherein:

a support member with a recess is provided at an outer end of said housing and an outer end of said hollow tube, and said support members being adapted to be mounted on opposing walls of a room.

3. The clothes dryer as claimed in claim 1, wherein:

said tube is provided with an elongated slotted enclosure, said enclosure being adapted to receive hooks for hanging clothes.

4. The clothes dryer as claimed in claim 1, wherein:

said fan is a turbine.

5. The clothes dryer as claimed in claim 1, wherein:

said heater is a positive temperature coefficient heater.

* * * * *